US010315799B2

(12) United States Patent
Behrens et al.

(10) Patent No.: US 10,315,799 B2
(45) Date of Patent: Jun. 11, 2019

(54) PALLETIZED INTEGRATED BOX

(71) Applicant: ASTROCYTICAL, INC., Tuscaloosa, AL (US)

(72) Inventors: Scott Behrens, Noblesville, IN (US); Landon C. G. Miller, Tuscaloosa, AL (US)

(73) Assignee: Aemerge, LLC, Hesperia, CA (US)

( * ) Notice: Subject to any disclaimer, the term of this patent is extended or adjusted under 35 U.S.C. 154(b) by 0 days.

(21) Appl. No.: 15/692,847

(22) Filed: Aug. 31, 2017

(65) Prior Publication Data

US 2019/0061997 A1 Feb. 28, 2019

(51) Int. Cl.
*B65D 19/00* (2006.01)
*B65D 77/04* (2006.01)

(52) U.S. Cl.
CPC ..... *B65D 19/0012* (2013.01); *B65D 19/0026* (2013.01); *B65D 77/0466* (2013.01); *B65D 2519/00019* (2013.01); *B65D 2519/00054* (2013.01); *B65D 2519/00089* (2013.01); *B65D 2519/00273* (2013.01); *B65D 2519/00293* (2013.01); *B65D 2519/00373* (2013.01); *B65D 2519/00562* (2013.01)

(58) Field of Classification Search
CPC ..... B65D 19/00; B65D 19/02; B65D 19/06; B65D 19/20; B65D 19/0012; B65D 19/0026; B65D 77/0466; B65D 2519/00019; B65D 2519/00054; B65D 2519/00089; B65D 2519/00273; B65D 2519/00293; B65D 2519/00373; B65D 2519/00562
USPC ..... 206/386, 595–600
See application file for complete search history.

(56) References Cited

U.S. PATENT DOCUMENTS 3,036,752 A * 5/1962 Elliott ..... B65D 5/5028 206/386
3,993,191 A * 11/1976 Membrino ..... B65D 19/0012 206/386
5,350,066 A * 9/1994 Mendoza ..... B65D 19/20 206/386
5,450,965 A * 9/1995 Cox ..... B65D 71/02 206/597

(Continued)

FOREIGN PATENT DOCUMENTS

CA 2995935 A1 * 3/2017 ..... B65D 19/0073
WO WO-9312979 A1 * 7/1993 ..... B65D 19/0012

(Continued)

*Primary Examiner* — Bryon P Gehman
(74) *Attorney, Agent, or Firm* — Avery N. Goldstein; Blue Filament Law PLLC

(57) ABSTRACT

An integrated container with a box and pallet is provided that is made entirely of corrugated materials, and is fully compatible with automated systems and methods for the safe collection, transfer, and treatment of infectious and hazardous waste. The integrated box and pallet made entirely of corrugated materials provides an improved high strength packaging solution that allows for safe transport of waste to a disposal location. The corrugated pallet and box are compatible with shredders and does not require metal fasteners. The corrugated pallet and box are completely recyclable, and may be made of a cardboard or of plastic. Separate waste collection containers may be collected and placed in the box of integrated container.

19 Claims, 13 Drawing Sheets

(56) References Cited

U.S. PATENT DOCUMENTS

| | | | | |
|---|---|---|---|---|
| 6,041,959 | A * | 3/2000 | Domanico | B65F 1/02 220/23.83 |
| 6,050,410 | A * | 4/2000 | Quirion | B65D 19/20 206/386 |
| 6,070,726 | A * | 6/2000 | Graham | B65D 19/0012 206/386 |
| 7,290,664 | B2 * | 11/2007 | Kono | B65D 19/20 206/600 |
| 7,963,397 | B2 * | 6/2011 | Seagle | B65D 19/18 206/600 |
| 8,146,516 | B2 * | 4/2012 | Linares | B65D 19/0018 108/51.3 |
| 8,701,569 | B2 * | 4/2014 | Linares | B65D 19/0026 108/51.3 |
| 8,801,904 | B2 | 8/2014 | Miller et al. | |
| 9,199,764 | B2 * | 12/2015 | Smolenaers | B65D 19/0016 |
| 9,738,414 | B2 * | 8/2017 | Takeuchi | B65D 19/0095 |
| 2009/0123687 | A1 * | 5/2009 | Chakraborty | E04C 2/365 428/76 |
| 2018/0297339 | A1 * | 10/2018 | Fergusson | B65D 19/0004 |

FOREIGN PATENT DOCUMENTS

| | | | |
|---|---|---|---|
| WO | 2016115148 | A1 | 7/2016 |
| WO | 2016145339 | A1 | 9/2016 |

* cited by examiner

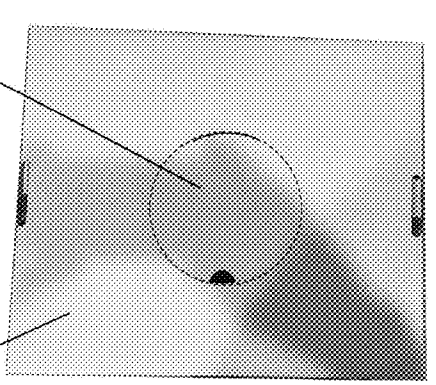
FIG. 7A
FIG. 7B
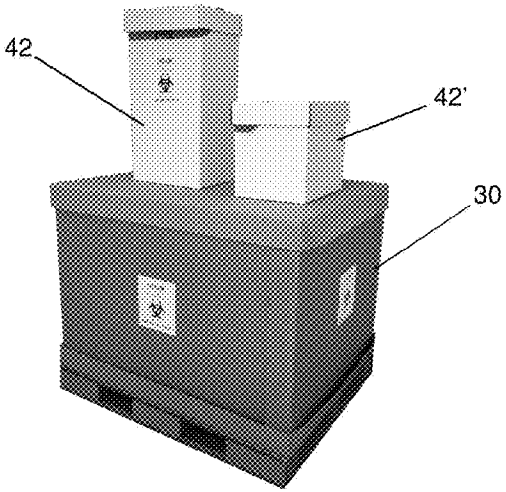
FIG. 7C

PALLETIZED INTEGRATED BOX

FIELD OF THE INVENTION

The present invention in general relates to packaging; and in particular to a box integrated to a pallet formed entirely of corrugated materials.

BACKGROUND OF THE INVENTION

A pallet is a flat transport structure that supports goods in a stable fashion while being lifted by a forklift, pallet jack, front loader, or other jacking device. A pallet is the structural foundation of a unit load which allows handling and storage efficiencies. Goods or shipping containers are often placed on a pallet secured with strapping, stretch wrap or shrink wrap and shipped. Pallets have dramatically supplanted older forms of crating like the wooden box and the wooden barrel, as pallets work well with modern packaging like cardboard boxes and intermodal containers commonly used for bulk shipping.

FIG. 1 shows a typical wooden pallet 10 with a series of top deckboards 12 secured with nails 14 to the top surface of stringers or runners 16. The bottom surface of the stringers or runners 16 are further secured to lower deckboards 18 with nails as well. A common application of pallets, or a variation of the pallet called a skid, is to be joined with a bulk box or bulk bin, where the bulk box/bin is often made of corrugated fiberboard that is either doublewall or triplewall. The combination of the bulk box/bin with a pallet or skid is commonly referred to as a gaylord, which derives the name from the Gaylord Container Company that originated the combination. FIG. 2 is a prior art gaylord 20 with an octagonal shaped box 22 with a corresponding lid 24 positioned on a wooden skid 26 formed with a top board 28 attached to the top surface of stringers or runners 16.

Infectious medical waste is generated in the research, diagnosis, treatment, or immunization of human beings or animals and has been, or is likely to have been contaminated by organisms capable of causing disease. Infectious medical waste includes items such as: cultures and stocks of microorganisms and biologicals; blood and blood products; pathological wastes; radiological contrast agents, syringe needles; animal carcasses, body parts, bedding and related wastes; isolation wastes; any residue resulting from a spill cleanup; and any waste mixed with or contaminated by infectious medical waste. Facilities which generate infectious medical waste include: hospitals, doctors offices, dentists, clinics, laboratories, research facilities, veterinarians, ambulance squads, and emergency medical service providers, etc. Infectious medical waste is even generated in homes by home health care providers and individuals, such as diabetics, who receive injections at home.

Before infectious medical waste can be disposed of the waste must be sterilized. Traditional sterilization methods include: incineration; steam treatment or autoclaving; and liquid waste may be disposed of in approved sanitary sewers. More recent methods that have been developed include microwave irradiation and use of various chemical washes.

Transforming waste from a liability to an asset is a high global priority. Currently employed technologies that rely on incineration to dispose of carbonaceous waste with useable quantities of heat being generated while requiring scrubbers and other pollution controls to limit gaseous and particulate pollutants from entering the environment. Incomplete combustion associated with conventional incinerators and the complexities of operation in compliance with regulatory requirements often mean that waste which would otherwise have value through processing is instead sent to a landfill or incinerated off-site at considerable expense. As medical waste often contains appreciable quantities of synthetic polymers including polyvinyl chloride (PVC), incineration of medical waste is often accompanied by release of chlorine, $ClO_x$, $SO_x$, and $NO_x$ air pollutants that must be scrubbed from the emitted gases. Alternatives to incineration have met with limited success owing to complexity of design and operation outweighing the value of the byproducts from waste streams.

While there have been many advances in the treatment and disposal of infectious waste, the use of wooden pallets that are fastened together with nails to transport waste are in general hard to grind and shred. The construction of the wooden pallets may disrupt the operation of the grinder and shredders in the treatment facility. Thus, there exists a need for improved high strength packaging solutions that allow for safe transport of the waste to a disposal location, and where the packaging is compatible with automated systems and methods for treatment of infectious and hazardous waste.

SUMMARY OF THE INVENTION

An integrated container includes a pallet made entirely of corrugated materials, and a box made entirely of the corrugated materials joined to the pallet. The pallet further includes a corrugated top platform, a series of corrugated spacers, and a corrugated bottom platform, where an inner surface of the top platform attaches to the series of corrugated spacers that rest on and are attached to an upper surface of the corrugated bottom platform.

A system is provided for treatment and destruction of hazardous and infectious waste, where the waste is delivered in integrated containers each formed of a pallet joined to box both made entirely of corrugated materials. The system includes a computer server with a database connected to a network, and a first reader to record identifying information about each of a set of the integrated containers into inventory, the set of containers holding hazardous and infectious waste delivered for disposal, where the first reader is connected via the network to the computer server. The system further includes waste processing line with a process control computer that controls the waste processing line and is connected to the network. The waste processing line further includes a second reader to record the set of integrated containers as the integrated containers are moved from inventory into the waste processing line, the second reader in electrical communication with the process control computer, a sealed enclosure, a shredder within the sealed enclosure, a belt conveyor to supply the set of waste, the belt conveyor running from an exterior of the sealed enclosure to the shredder; an oxidizer in fluid communication with the sealed enclosure adapted to destroy airborne infectious matter from the sealed enclosure, a feed conveyor for transfer of shredded material from the shredder to a carbonizer, the carbonizer having a chain belt to move shredded material through the carbonizer; and an analyzer that provides analysis of remaining non-useable outputted waste, the analyzer in electrical communication with the process control computer.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

FIG. 7A is a front perspective view of a plastic lined medical waste collection container for use with the corrugated pallet of FIG. 3 in accordance with an embodiment of the invention;

FIG. 7B is a top view of the box cover of the waste collection container of FIG. 7A illustrating the pull up lid formed in the cover in accordance with embodiments of the invention;

FIG. 7C is a perspective view illustrating different sized medical collection containers in relation to the corrugated pallet of FIG. 3 in accordance with an embodiment of the invention;

DESCRIPTION OF THE INVENTION

The present invention has utility as an integrated container with a box and pallet made entirely of corrugated materials that is fully compatible with automated systems and methods for the safe collection, transfer, and treatment of infectious and hazardous waste. The use of wooden pallets that are fastened together with nails to transport waste are in general hard to grind and shred. Furthermore, the construction of the wooden pallets may disrupt the operation of the grinder and shredders in the treatment facility. The use of embodiments of the inventive integrated box and pallet made entirely of corrugated materials provides an improved high strength packaging solution that allows for safe transport of the waste to a disposal location, and where the packaging is compatible with automated systems and methods for treatment of infectious and hazardous waste. The corrugated pallet and integrated box are compatible with shredders and does not require metal fasteners. Embodiments of the corrugated pallet and box are completely recyclable, and may be made of a cardboard or of plastic.

Figure 1:
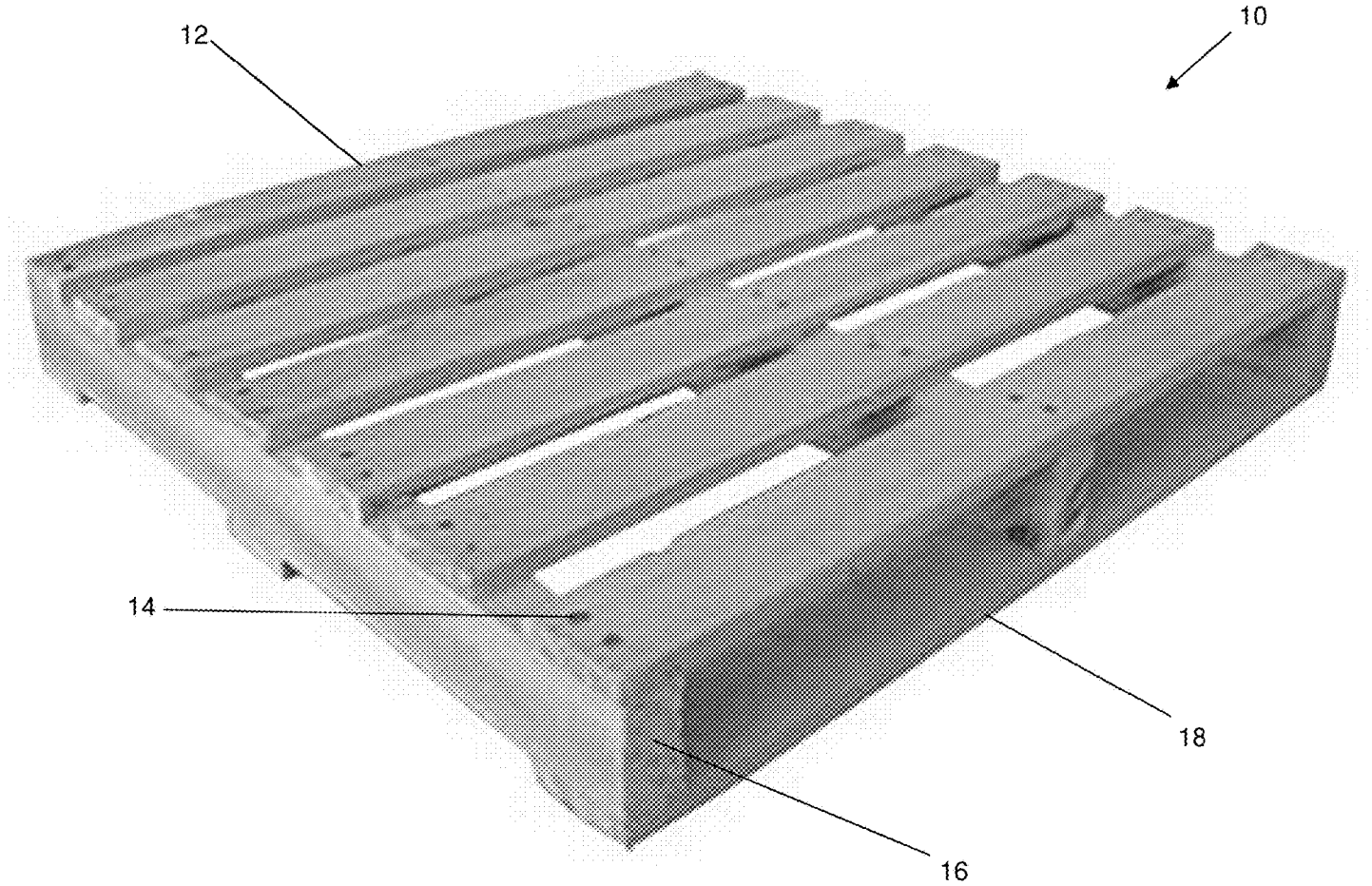
FIG. 1 (Prior art)
FIG. 1 is a perspective view of a typical prior art pallet.
Figure 3:
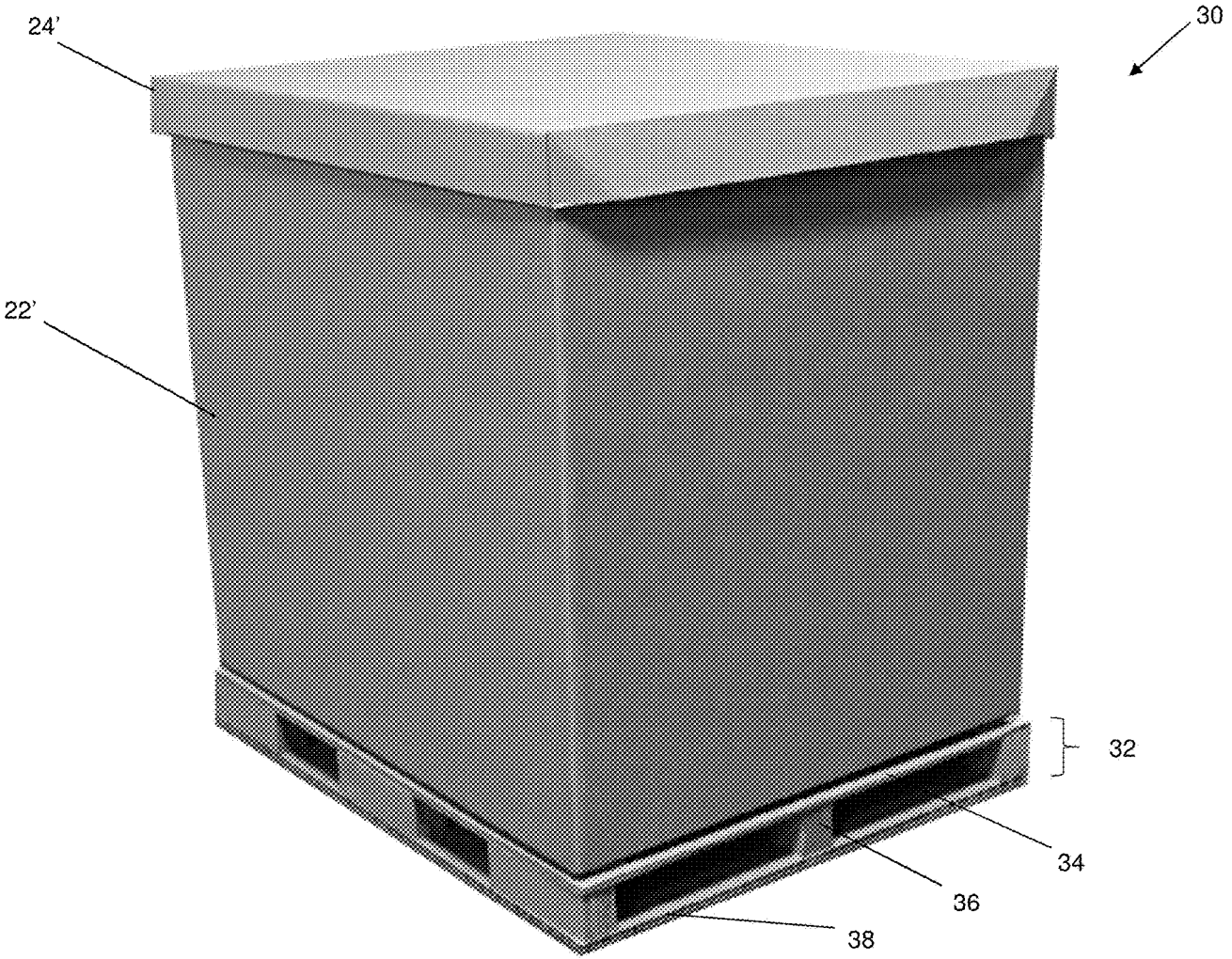
FIG. 3 is a perspective view of a gaylord with a rectangular corrugated box and cover attached to a corrugated pallet in accordance with an embodiment of the invention.
Figure 4:
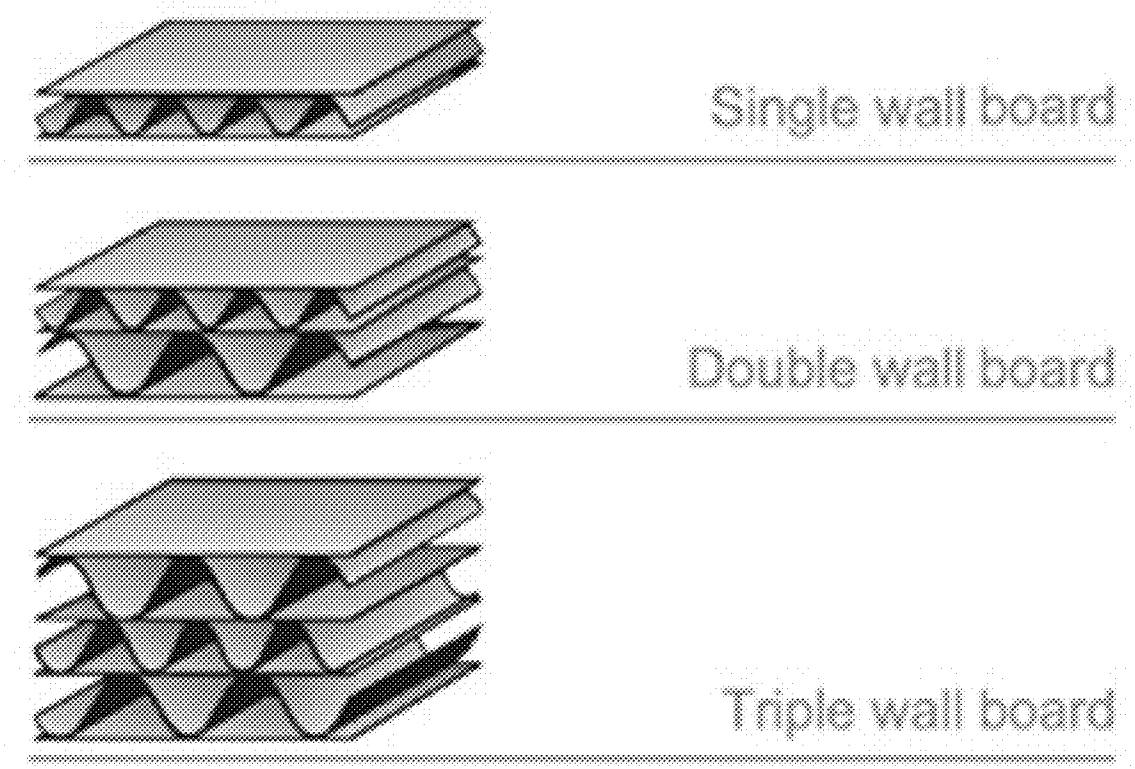
FIG. 4 (Prior art)
FIG. 4 is a cross sectional view of the wall construction of various embodiments of the corrugated material used in embodiments of the invention.

Referring now to the figures, FIG. 3 illustrates an embodiment of an integrated container 30 with a box 22', lid cover 24', and pallet 32 that are made entirely of corrugated materials (cardboard or plastic) to form a completely corrugated gaylord 30. It is appreciated that while a square gaylord is depicted in FIG. 1, alternative shapes illustratively including rectangles, octagons, and cylinders may be used for the container portion of the integrated box and corrugated pallet. The container portion or box 22' may be single walled, double walled, or triple walled as shown in cross section in FIG. 4. A plastic liner may be included in the box 22' to contain liquids or moisture. Embodiments of the corrugated pallet 32 may have a square or rectangular shape that is conducive for use with loading equipment and for stacking. The components that form the corrugated pallet may be double walled, triple walled, or even more layers depending on the load to be carried. Unlike the wavy flutes shown in FIG. 4, a honeycomb pattern may be used between the cardboard or plastic walls of each layer.

Figure 2:
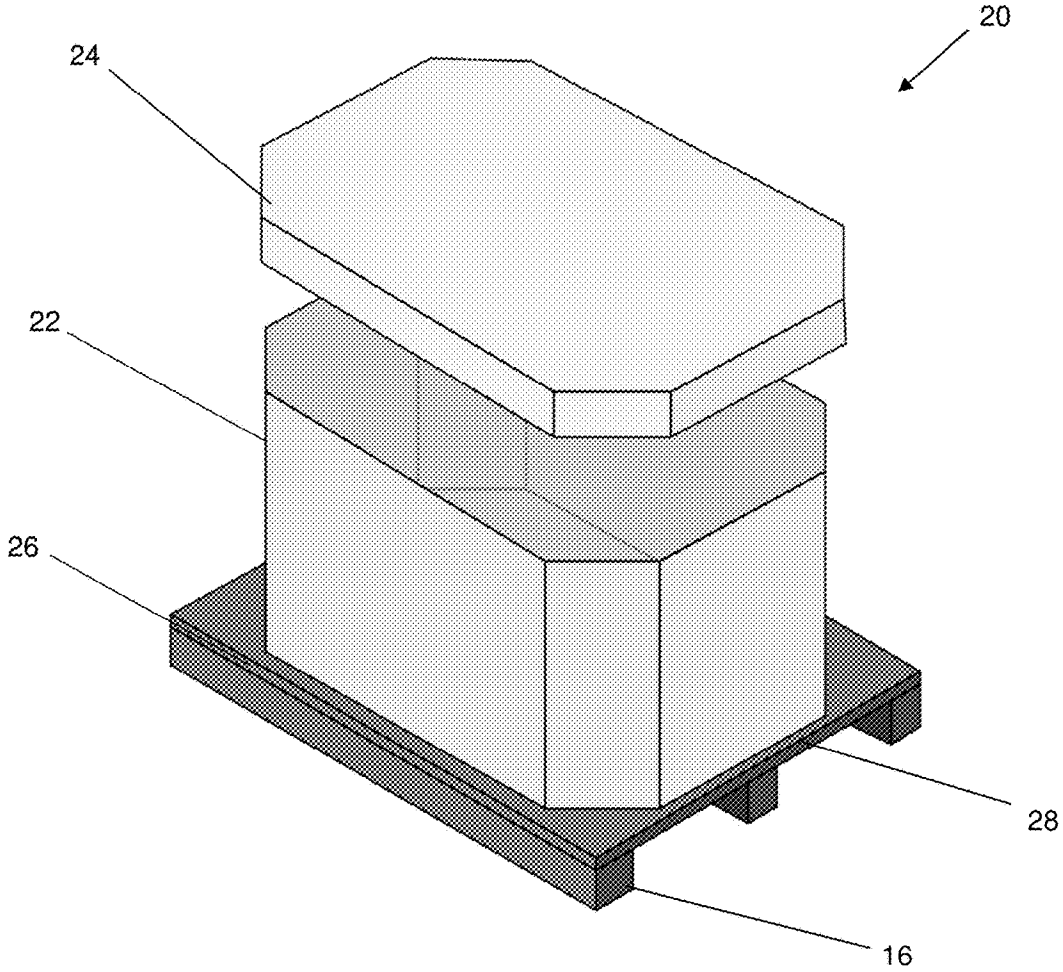
FIG. 2 (Prior art)
FIG. 2 is a perspective view of a typical prior art gaylord with an octagonal shaped box and cover.
Figure 5A:
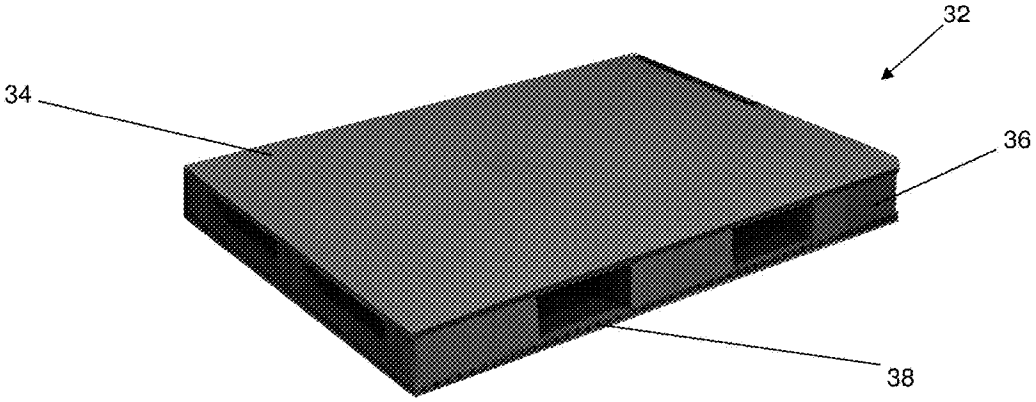
FIGS. 5A and 5B are a perspective view and a side view, respectively of the corrugated pallet of FIG. 3 in accordance with an embodiment of the invention.
Figure 5B:
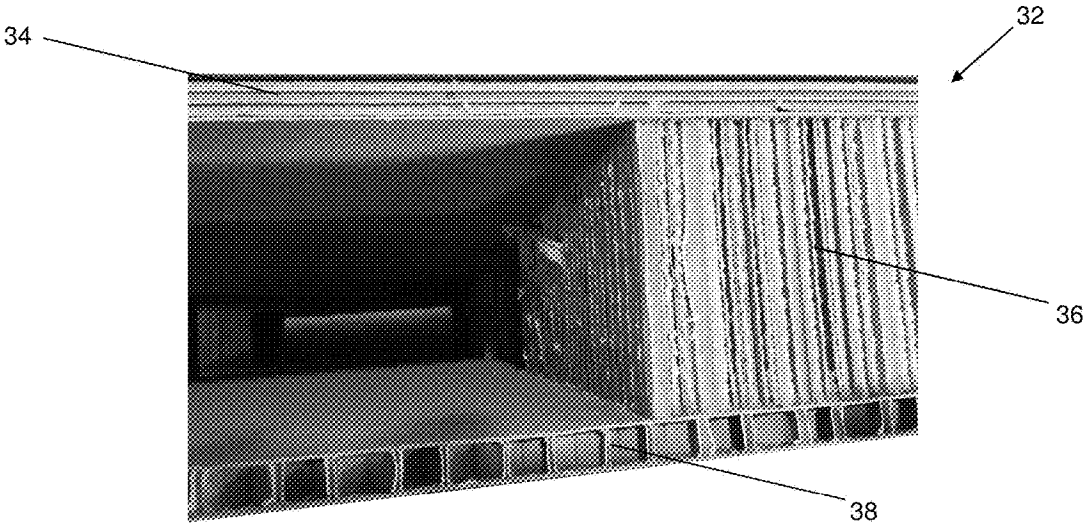
Figure 5C:
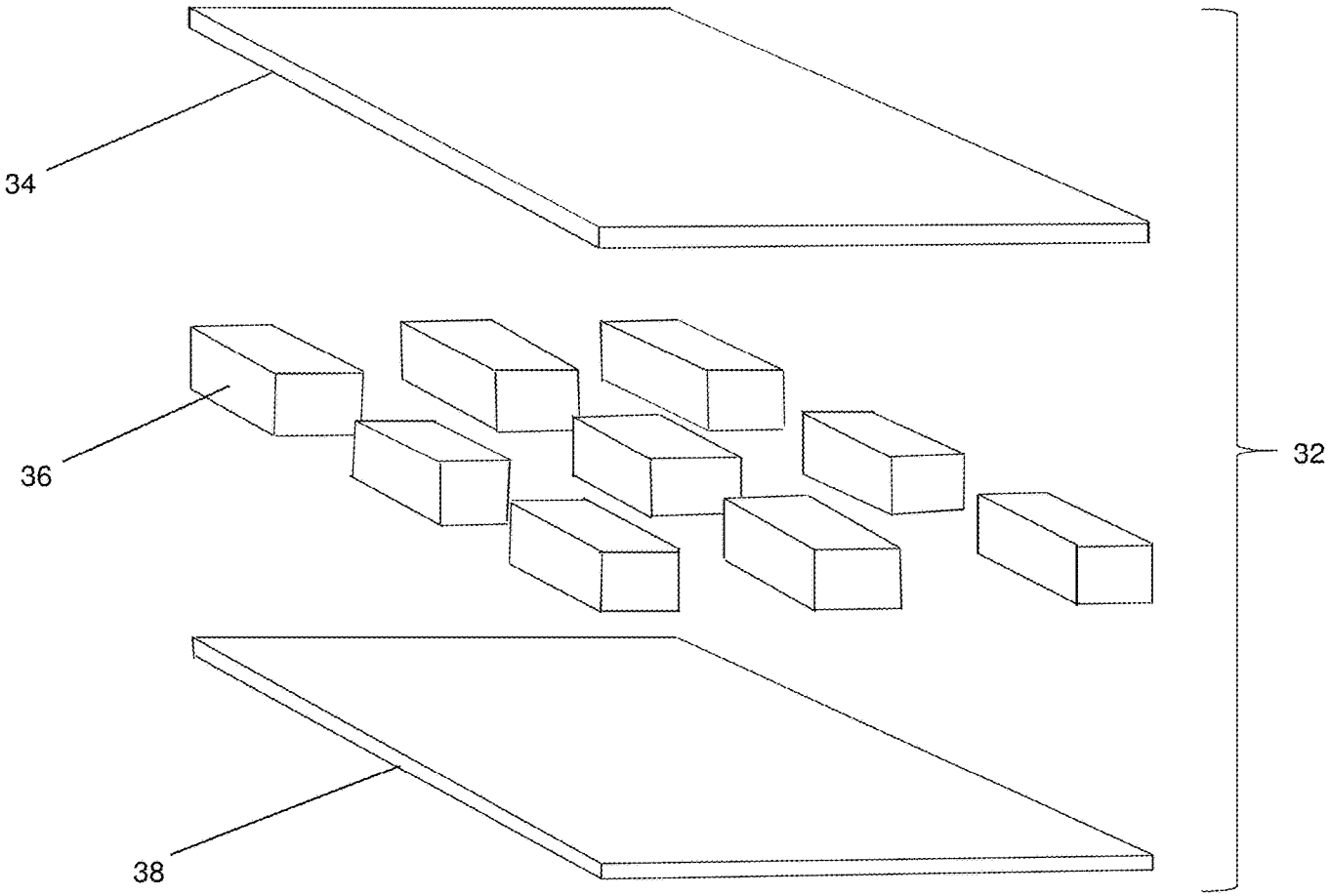
FIG. 5C is an exploded view of the corrugated pallet of FIG. 3 in accordance with an embodiment of the invention.
Figure 6:
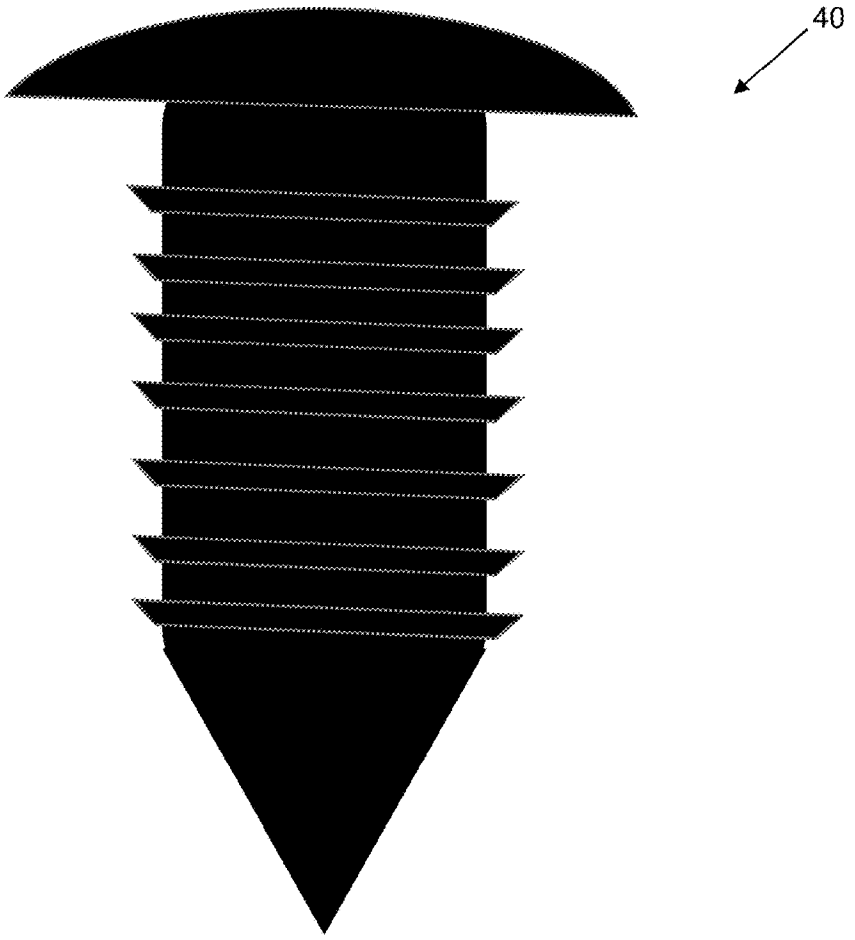
FIG. 6 is a side view of a press fit securement for joining layers of the corrugated pallet in accordance with embodiments of the invention.

FIGS. 5A and 5B are a perspective view and a side view, respectively of the corrugated pallet 32 of FIG. 3 As best shown in the exploded view of FIG. 5C, the corrugated pallet 32 has a corrugated top platform 34 that attaches to the box 22'. The inner surface of the top platform 34 attaches to a series of corrugated spacers 36 that rest on and are attached to the upper surface of a corrugated bottom platform 38. The spacers 36 are positioned to allow a forklift or other lifting device to insert lifting arms beneath the top platform 34. It is appreciated that the spacers 36 are shown as a pattern of nine individual spacers 36 to allow forklift engagement access from any side of the four sides of the corrugated pallet 32, however the spacers 36 may be configured as shown for the continuous stringers or runners 16 in FIGS. 1 and 2 that only allow forklift engagement access from two opposing sides of the corrugated pallet 32. As shown in FIG. 5B the top layer 34 is formed by a series of cardboard sheets bonded together, while the corrugated bottom platform 38 has a honeycomb pattern between the outer layers of the corrugated bottom platform 38. Also, visible in FIG. 5B the spacers 36 are formed by a series of corrugated cardboard sheets bonded together. The layers of the corrugated pallet 32 formed by the top platform 34, spacers 36, bottom platform 38 may be joined to each other by adhesives, tapes, staples, or other securements including barbed plastic press fits 40 as shown in FIG. 6 that insert through the layers for attachment via the top platform 34 and the bottom platform 38. In embodiments where the corrugated pallet 32 is formed with plastics, spot welding may be used to fuse the layers together FIG. 7A is a front perspective view of a plastic lined medical waste collection container 42 for use with the integrated container 30 of FIG. 3. The waste collection container 42 may be made of cardboard or recyclable plastic, and come in varying sizes as shown in FIG. 7C as 42 and 42' and are designed to be placed or nested within the integrated container 30. It is appreciated that the waste collection containers (42, 42') may come in additional sizes and shapes then shown, and are designed to fit into the larger corrugated pallet 30. The waste collection container 42 has a cover 44 and a plastic liner 46 to contain fluids within the box 48 portion of the waste collection container 42. The plastic liner 46 may have a draw string or double-sided draw string to close an interior bag formed from the plastic liner 46. FIG. 7B illustrates the box cover 44 with a pull up lid 45 formed in the cover 44. In practice, separate waste collection containers 42 may be individually positioned in various examining and operating rooms in a medical facility, and are then collected when full and placed in the integrated container 30 for offsite disposal.

Embodiments of inventive corrugated integrated box and pallet may be used with a medical waste handling and shredding sub-system, as disclosed in co-pending applications PCT/US16/13067 "Infectious Waste Disposal" filed Jan. 12, 2016, PCT/US16/22061 "Integrated Collection of Infectious Waste and Disposal Thereof" filed Mar. 11, 2016, and U.S. patent application Ser. No. 15/292,516 "Auditable Infectious and Hazardous Waste Disposal" filed Oct. 13, 2016 all of which are included by reference in their entirety herein, that feeds partially processed waste to an oxidizer to eliminate potential airborne infectious waste prior to transforming the medical waste into useful co-products. In accordance with the present invention, medical waste in the inventive corrugated containers is transformed into value added products including hydrocarbon based gases, hydrocarbon-based liquids, carbonized material, and recovered precious metals and rare earth materials in a system having as its transformative element an anerobic, negative pressure, or carbonization system. With medical waste as a feedstock for the production of valuable products, the present invention provides an economically viable and environmentally more responsible alternative to traditional methods of medical waste treatment.

Figure 8:
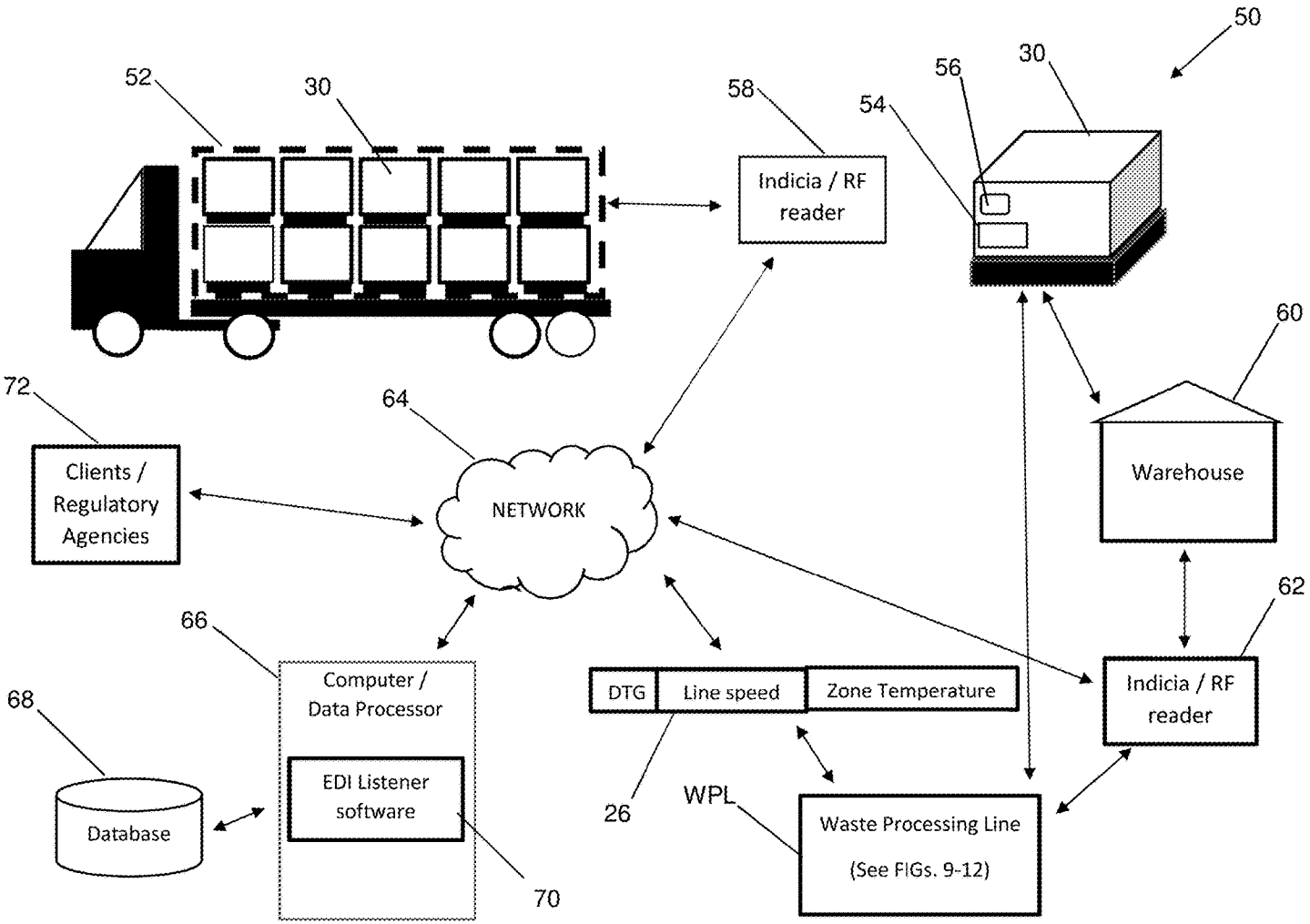
FIG. 8 is a block diagram of an overall system for auditable infectious waste treatment incorporating the use of the corrugated pallets integrated to boxes for transport of the infectious waste according to an embodiment of the invention.

Embodiments of inventive integrated container 30 formed with corrugated box 22' and pallet 32 are shown as being delivered on a truck 52 in FIG. 8 of a block diagram of an overall system 50 for auditable infectious waste treatment. Each of the individual integrated corrugated containers 30 may be identified with at least one of a machine-readable indicia 54 or a radio frequency identification tag 56 (RFID). The machine-readable indicia 54 may illustratively include barcodes and quick response (QR) codes. Upon delivery of the waste to be processed, the indicia 54 are read or the RFID 56 are scanned with the reader 58. If the containers 30 are coded with RFID tags 56, the truck 52 may be driven through an overhead gantry that holds the reader 58 to read the contents of the truck. The scanned integrated corrugated containers 30 of waste may be placed in a warehouse 60 as inventory or sent directly to a waste processing line (WPL). If the waste is warehoused, the containers 30 are rescanned with reader 62 as the containers of waste are removed from inventory and introduced to the waste processing line (WPL). The scanned identifying information from the containers 30 are sent via a network 64 to a computer server 66 that maintains a database 68. In a specific embodiment, the database 68 is based on enterprise resource planning (ERP), which is a category of business-management software—typically a suite of integrated applications—that an organization can use to collect, store, manage and interpret data from many business activities, including: product planning, purchasing, manufacturing, or service delivery.

Continuing with FIG. 8, the waste is processed using a waste processing line (WPL) that is described in further detail in FIGS. 9-12. Processing may be tracked in units of time referred to as a "time fence" which is an allowable processing window. A process control computer system 101 in FIG. 9 produces a log of various processing parameters. Processing parameters may illustratively include derivative thermogravimetric (DTG), conveyor line speed, and carbonizer temperature by zone. Thermalgravimetric analysis (TGA) is a method of thermal analysis in which changes in physical and chemical properties of materials are measured as a function of increasing temperature (with constant heating rate), or as a function of time (with constant temperature and/or constant mass loss). TGA can provide information about physical phenomena, such as second-order phase transitions, including vaporization, sublimation, absorption, adsorption, and desorption. Likewise, TGA can provide information about chemical phenomena including chemisorptions, desolvation (especially dehydration), decomposition, and solid-gas reactions (e.g., oxidation or reduction). TGA may be used to determine selected characteristics of materials that exhibit either mass loss or gain due to decomposition, oxidation, or loss of volatiles. The analysis may be conducted with analyzer 105 with the information sent with the network interface controller 103 via network 64. The network 64 may be a local area network (LAN), wide area network (WAN), or the Internet. Information may be sent via wired or wireless mediums. In a specific inventive embodiment, the collected information from the auditable waste processing system is in a standardized format that allows for electronic data interchange (EDI). EDI allows computer to computer information transfer without human intervention. The an EDI listener 70 shown in the computer server 66 "listens" for EDI protocols and accepts data that is sent in acceptable formats to be included in the database 68. Waste process information may be retrieved from the database 68 by the computer 66 to generate reports and conduct audits that are made available to clients and regulatory agencies 72.

Figure 9:
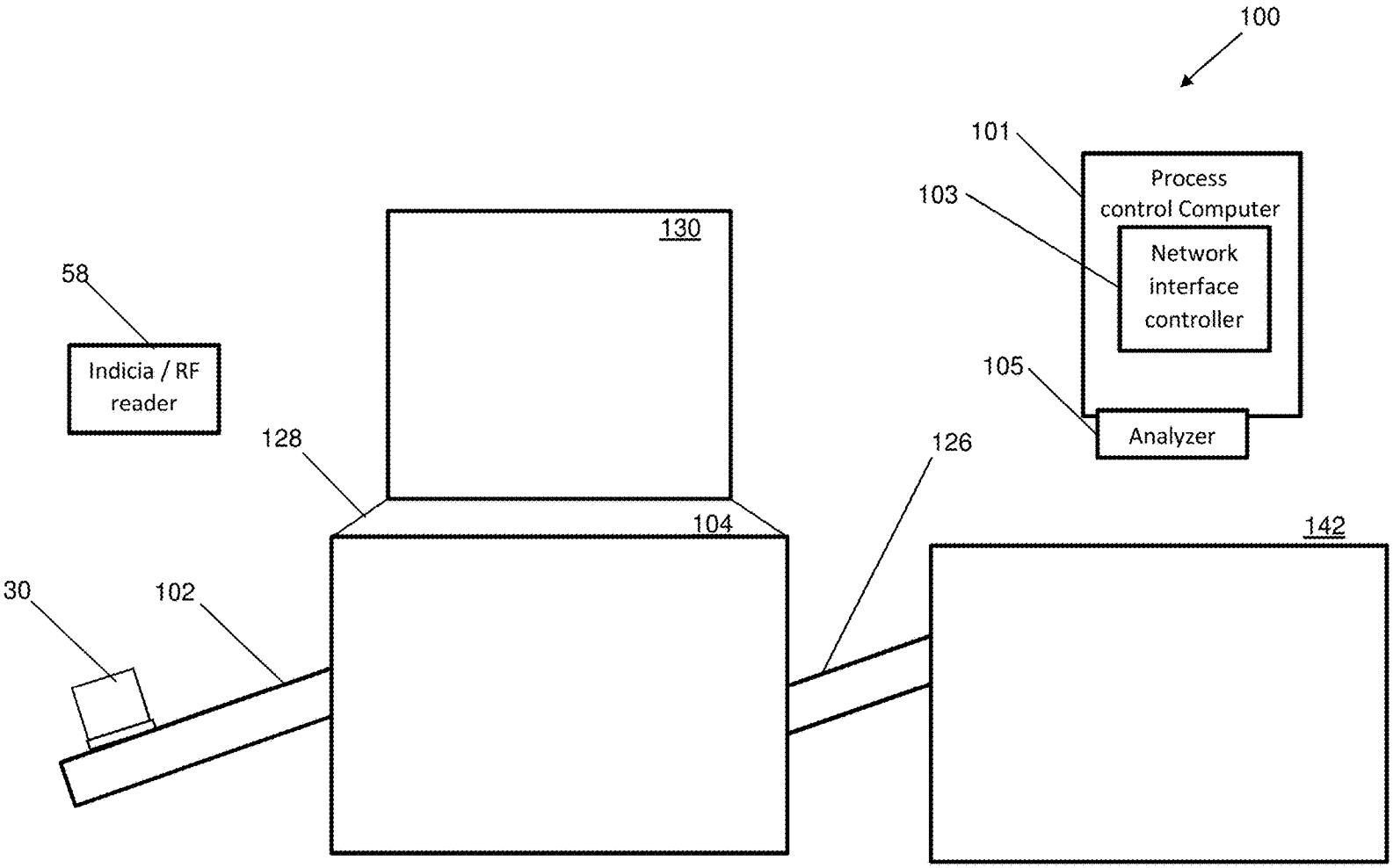
FIG. 9 is a block diagram of a prior art infectious waste treatment system for use with the corrugated pallets integrated to boxes according to an embodiment of the invention.

FIG. 9 is a block diagram of an infectious waste treatment system 100 according to an embodiment of the invention. An encapsulated shredding and infectious matter escape prevention sub-system 104 encloses a shredder in a negative pressure sealed environment that acts to contain residue and contaminants from escaping into the environment during the shredding operation of the integrated corrugated containers 30 with infectious waste. The integrated corrugated containers 30 with infectious waste are loaded into the sub-system 104 via belt conveyor 102. The belt conveyor 102 introduces the infectious or contaminated waste in integrated containers 30 that are scanned with reader 58 as the integrated containers 30 of waste are introduced into the subsystem 104. An oxidizer 130 destroys any airborne infectious matter that exits through hood 128 at the top of the sub-system 104.

As used herein an oxidizer is defined to also include a thermal oxidizer and catalytic oxidizer; such systems are commercially available and in widespread usage.

Feed conveyor 126 transfers the shredded material from the sub-system 104 to the carbonizer 142. It is appreciated that feed conveyor 126 also includes augers, shuttle bins, and other conventional devices to transit shredded material. The analyzer 105 may be used to analyze the outputted waste, illustratively including thermalgravimetric analysis (TGA). Physical samples—aliquots of the outputted treated waste may be taken, packaged and labeled with lot information, and saved by the analyzer 105. The process control computer 101 controls the operating parameters of the system 100, and the network interface 103 provides formatted information to the network 64.

Figure 10:
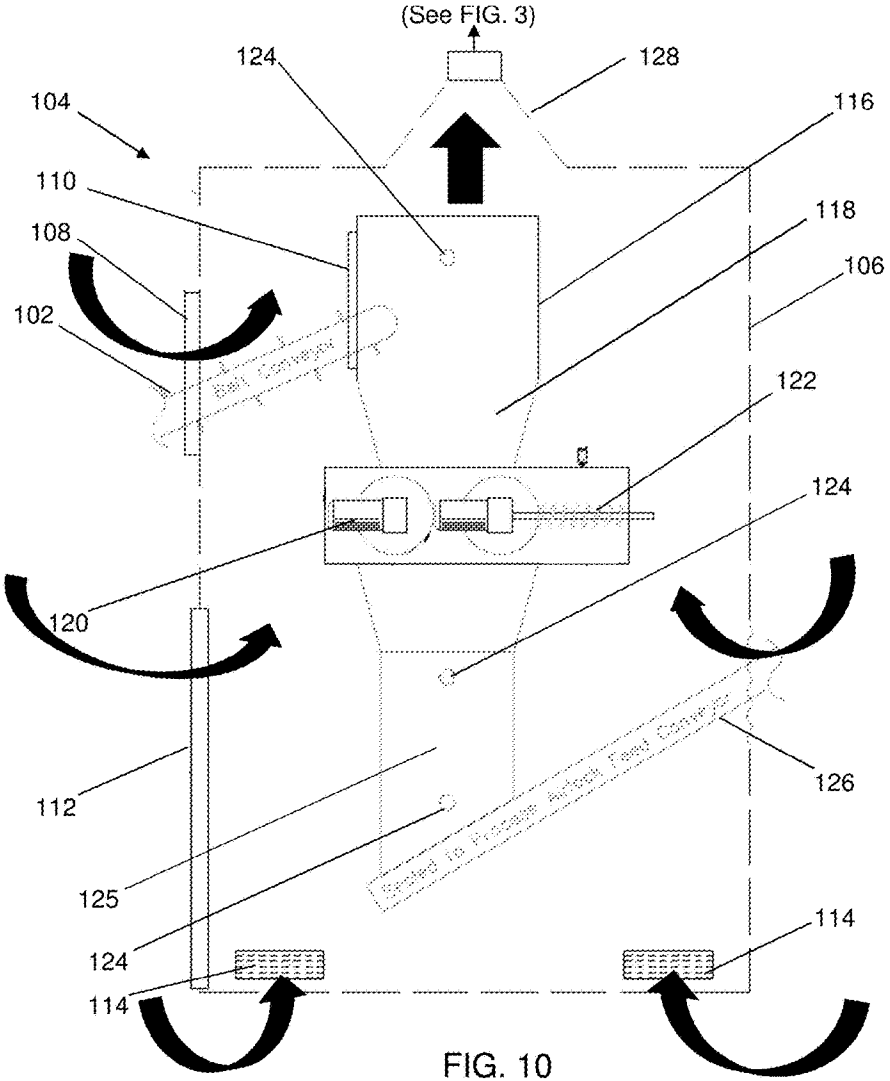
FIG. 10 is a side section view depicting a prior art encapsulated shredding and infectious matter escape prevention sub-system for use with the corrugated pallets integrated to boxes according to an embodiment of the invention.

FIG. 10 is a side section view depicting the encapsulated shredding and infectious matter escape prevention subsystem 104. The dotted lines represent the containment walls 106 that enclose the shredder 116. The enclosure of the sub-system 104 is maintained at a negative pressure to draw in air (as opposed to expelling air) as represented by the arrows into the vents 114, as well as into the exterior flap 108 that permits containerized waste to enter the sub-system 104 via the belt conveyor 102, and other openings such as for the feed conveyor 126 and service door 112. The exterior flap 108 is readily formed of rubberized materials, polymeric sheeting, as well as metals. Service door 112 is provided in some inventive embodiments to allow service workers to enter the enclosure. It is appreciated that a service person may be required to wear protective clothing and a filter mask. In a specific embodiment, the service door 112 may be a double door airlock, where only one door is open at a time to minimize the escape of contaminants into the environment. In still other embodiments, the air handling system modifies operation during opening of the service door 112 to maintain a negative pressure during opening to inhibit airborne escape of potential pathogens. Hopper flap 110 acts to allow containerized waste to enter the hopper 118 of the shredder 116, while also acting as a seal around the belt conveyor 102. The hopper flap 110 is readily formed of rubberized materials, polymeric sheeting, as well as metals. At the bottom of the hopper 118, an auger 122 that is driven by one or more motors 120 shreds the waste. In an embodiment, the motors 120 may be variable frequency drive (VFD) motors. The shredded material is accumulated in a process airlock 125 that supplies material to a feed conveyor 126. Levels and presence of material within the hopper 118 and the process airlock 125 are controlled via sensors 124. In a specific embodiment, the sensors 124 are through beam sensors (TBS). Feed conveyor 126 is sealed to the process airlock 125, and transports the shredded material from the sub-system 104 to the carbonizer 142. Hood 128 collects airborne contaminants for introduction into the oxidizer (TO) 130.

Figure 11:
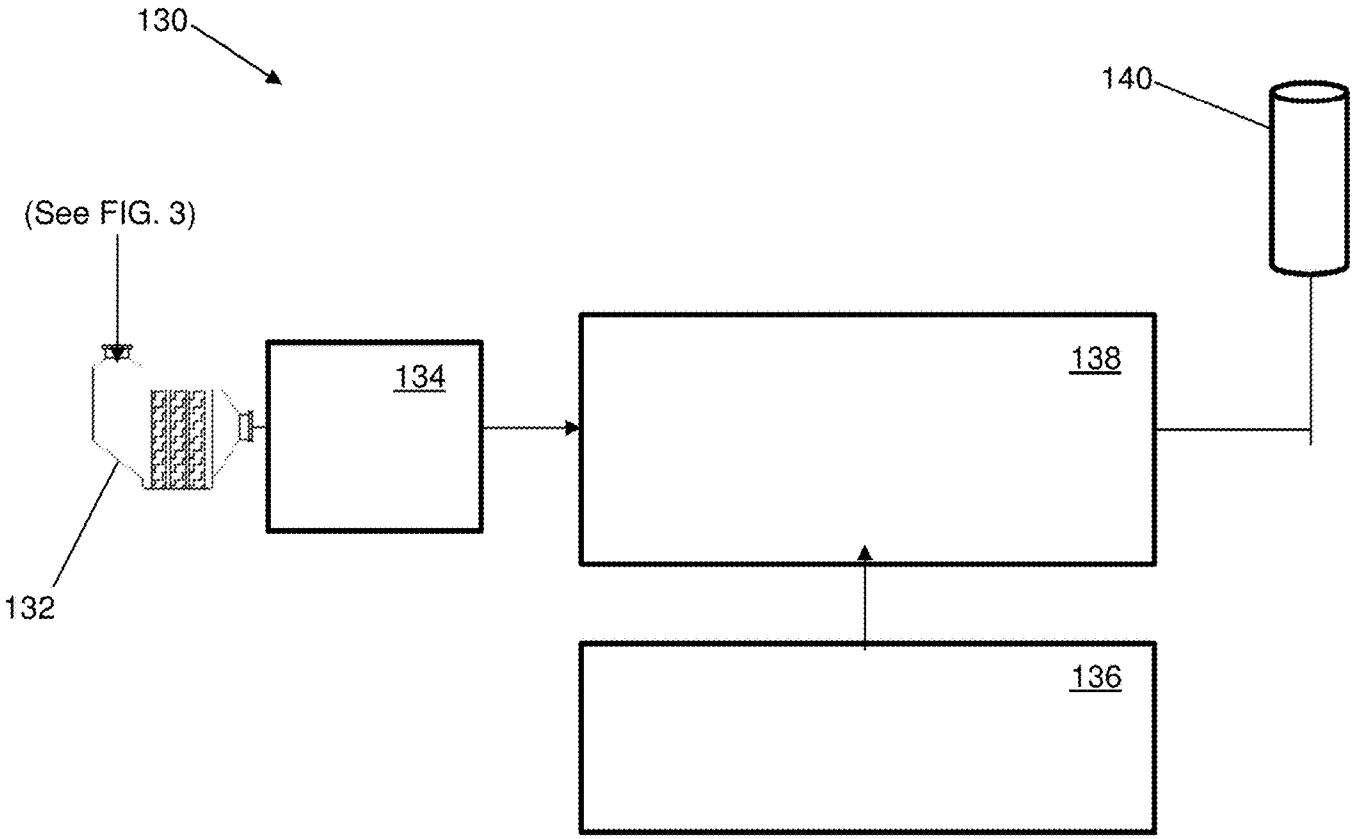
FIG. 11 is a prior art oxidizer adapted for use with embodiments of the invention.

FIG. 11 is a block diagram of an oxidizer 130 adapted for use with embodiments of the invention that acts as a fume incinerator for the containment room of sub-system 104. Large particle screener 132 filters out particles from the exhaust stream of airborne contaminants. A filter differential sensor may be employed to detect when a filter is clogged and requires replacement. A blower 134 draws in the exhaust stream and blows the exhaust stream into the combustion tube 138. A gas supply 136 supplies fuel for burners in the combustion tube 138. In specific embodiments, the oxidizer 130 is run on a mixture of natural gas and reaction-produced carbonization process gases re-circulated to transform the heat through the use of either conventional steam boilers or to Organic Rankin Cycle strategies to operate electrical turbine generators, or in the alternative, to reciprocating engine driven generators, and thereby generate the heat needed to produce power while also operating the carbonization process in the carbonizer 142. This heat capture produces more waste heat than is used to heat water and generate steam for turbines or steam reciprocating engines. This heat in some inventive embodiments is used to preheat feedstock or for other larger process purposes. The preprocessing heating system preheats feedstock material prior to entering the reactor tube to both reduce moisture and improve overall system yield. Roof exhaust stack 140 vents cleaned exhaust to the environment.

An apparatus for anaerobic thermal transformation processing as carbonizer 142 to convert waste into bio-gas; bio-oil; carbonized materials; non-organic ash is detailed in U.S. Pat. No. 8,801,904; the contents of which are incorporated herein by reference.

Figure 12:
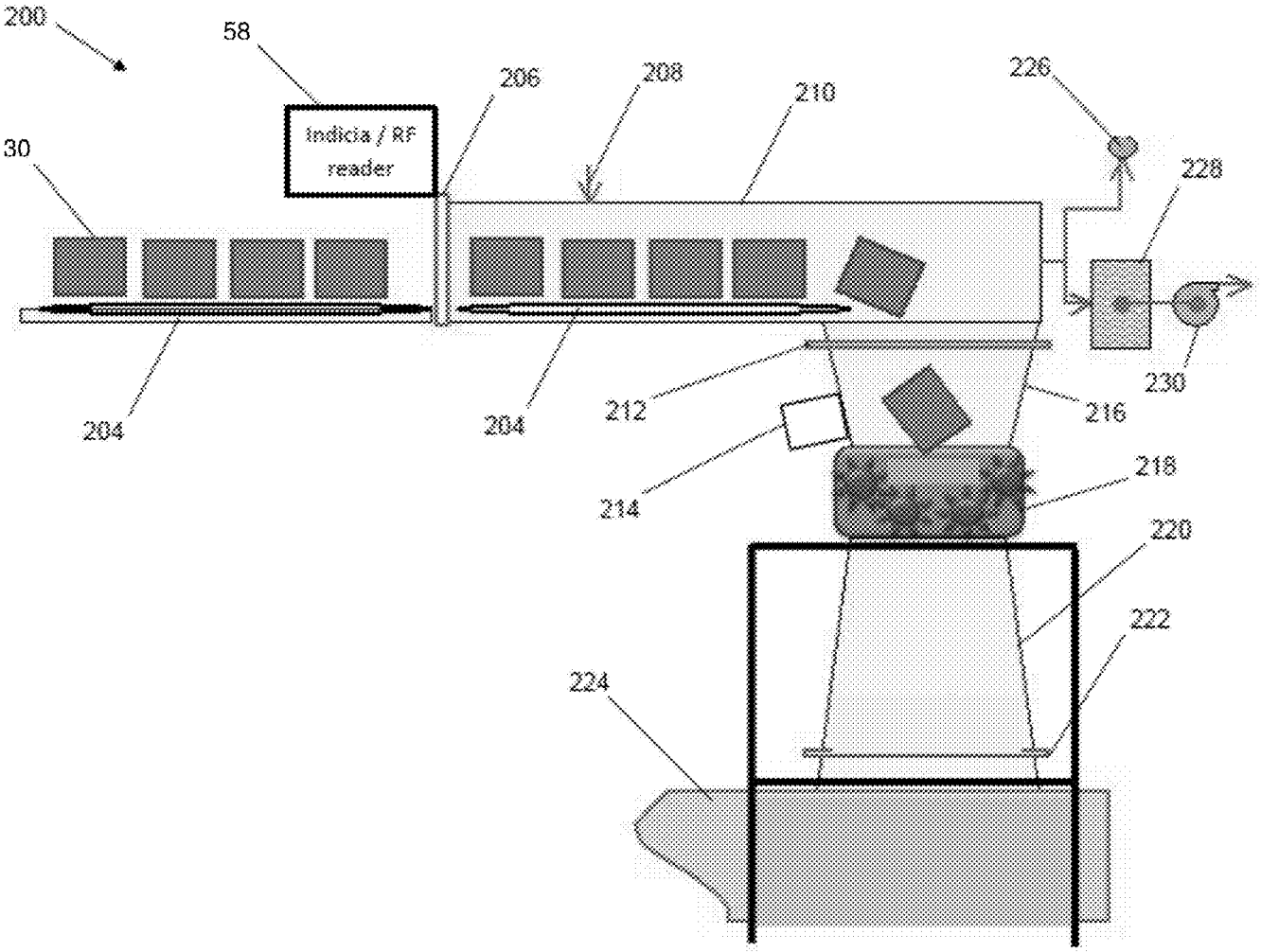
FIG. 12 is a block diagram of a prior art top loaded infectious waste treatment system compatible with according to an embodiment of the invention.

FIG. 12 illustrates a block diagram of a shredder feed system 200 for treatment and recovery of usable products from waste feedstock illustratively including medical and infectious waste, where the carbonizer 142 is that described with respect to the aforementioned drawings. The feed system 200 utilizes conveyers 204 to feed and transport integrated corrugated containers 30 of waste into and through the pre-shred air-lock tunnel 210 and into a shred feed hopper 216. The reader 58 reads the indicia or RFID tag on each of the containers 30 prior to entry into the pre-shred air-lock tunnel 210. The pre-shred air-lock tunnel 210 has an airtight open and close inlet valve (door) 206 and an outlet valve (door) 212 to the shred feed hopper 216. The pre-shred air-lock tunnel 210 may have nitrogen inputted at valve 208 to provide an inert atmosphere in the air-lock tunnel 210. In a specific embodiment, the waste may be treated with a wet scrubber 214. Medical waste that contains appreciable quantities of synthetic polymers including polyvinyl chloride (PVC), when incinerated is often accompanied by release of chlorine, $ClO_x$, $SO_x$, and $NO_x$ air pollutants that are preferably scrubbed from the emitted gases to limit air pollution. The wet scrubber 214 facilitates a reaction with chloride gas to yield a resultant hydrochloric acid (HCl) product. In order to withstand corrosion caused by HCl, and other byproducts produced in operation of an inventive system, system components are readily formed of solid-solution-strengthened, high-temperature corrosion-resistant alloys that are generally rich in nickel and chromium/cobalt as major constituents with illustratively include 37Ni-29Co-28Cr-2Fe-2.75Si-0.5Mn-0.5Ti-0.05C-1W-1Mo-1Cb, S13Cr, 316L (S31603), 22 Cr duplex, 25 Cr duplex, 28 (N08028), 825 (N08825), 2550 (N06975), 625 (N06625) C-276 (N10276), where parentheticals correspond to the UNS numbers for a particular alloy. These alloys are resistant to the effects of HCl may be used in the construction of one or more of the wet scrubber 214, shred feed hopper 216, shredder 218, and other components of the system 200 that may contact the corrosive HCl and chlorine, such as the sealed enclosure, the shredder, the belt conveyor, the oxidizer, or the feed conveyor.

Continuing with FIG. 12, the shredder 218 may be a two or four shaft shredder that is mounted so that all shredded waste material and liquids exit the bottom of the shredder 218 into a collection hopper 220 that meters and distributes the waste with a post-shred air-lock 222 directly into a carbonizer 142. It is appreciated, precious metals and rare-earth materials for example associated with medical imaging may be obtained by burning off the carbon product to obtain carbon dioxide and the resultant metal materials. For example, contrast agents used for radiological procedures are a source of precious metals and rare earths. Gasses from the air-lock tunnel are managed with an oxygen sensor 226 and escaping particulate is filtered with a high-efficiency particulate air (HEPA) filter 228, and is the expelled through a blower 230 to an oxidizer illustratively including a thermal oxidizer.

As a person skilled in the art will recognize from the previous detailed description and from the figures and claims, modifications and changes can be made to the preferred embodiments of the invention without departing from the scope of this invention defined in the following claims.

The invention claimed is:

1. An integrated container comprising:

a pallet made entirely of corrugated materials, said pallet comprising a corrugated top platform formed of a series of corrugated sheets bonded together, a series of corrugated spacers formed of a series of corrugated sheets bonded together, and a corrugated bottom platform having a honeycomb core bonded between a first corrugated sheet and a second corrugated sheet, wherein said series of spacers are disposed between said top platform and said bottom platform, and wherein the series of corrugated sheets of said series of spacers are perpendicular to the series of corrugated sheets of said top platform and the corrugated sheets of said bottom platform; and a box made entirely of said corrugated materials joined to said pallet.

2. The container of claim 1 wherein wherein an inner surface of said top platform attaches to said series of corrugated spacers that rest on and are attached to an upper surface of said corrugated bottom platform.

3. The container of claim 2 wherein said series of spacers are arranged in a pattern of nine individual spacers to allow a forklift engagement access from any side of four sides of said pallet.

4. The container of claim 2 wherein said series of spacers are continuous stringers or runners that only allow a forklift engagement access from two opposing sides of said pallet.

5. The container of claim 2 wherein said top platform, said spacers, and said bottom platform are joined together with at least one of adhesives, tapes, staples, and barbed plastic press fits.

6. The container of claim 1 wherein said corrugated materials further comprise at least one of cardboard or plastic.

7. The container of claim 1 wherein said box is a square, rectangle, octagon, or a cylinder.

8. The container of claim 1 wherein said pallet has a square or rectangular shape.

9. The container of claim 1 wherein said box further comprises a plastic liner.

10. The container of claim 1 wherein said box is one of single walled, double walled, or triple walled.

11. The container of claim 1 wherein said pallet is formed with said corrugated materials being at least double walled.

12. The container of claim 1 wherein said corrugated materials have a plurality of wavy flutes.

13. The container of claim 1 wherein said corrugated materials have a honeycomb pattern.

14. The container of claim 1 wherein said container is completely recyclable.

15. The container of claim 1 wherein said box has a corresponding lid made of said corrugated materials.

16. The container of claim 1 wherein said corrugated material is made of plastic and said pallet and said box are joined by spot welds.

17. The container of claim 1 further comprising machine readable indicia as identifying information.

18. The container of claim 1 further comprising radio frequency identification tags as identifying information.

19. The container of claim 1 further comprising one or more waste collection containers for placement within the container.

* * * * *